US006969810B1

(12) United States Patent
Davidsz

(10) Patent No.: US 6,969,810 B1
(45) Date of Patent: Nov. 29, 2005

(54) ELECTRIC KEY SWITCH WITH KEY SENSING AND EJECTION

(75) Inventor: Mark E. Davidsz, Oak Creek, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 0 days.

(21) Appl. No.: 10/853,525

(22) Filed: May 25, 2004

(51) Int. Cl.[7] ..... H01H 27/06
(52) U.S. Cl. ..... 200/61.66; 200/61.68
(58) Field of Search ..... 200/61.66–61.68, 200/252, 260, 336, 273, 274, 43.04, 43.08; 70/380, 387, 388

(56) References Cited

U.S. PATENT DOCUMENTS

| | | | | |
|---|---|---|---|---|
| 2,623,959 | A * | 12/1952 | Jarrett | 200/43.04 |
| 3,661,000 | A * | 5/1972 | Kerr | 70/388 |
| 3,665,128 | A * | 5/1972 | Schaad et al. | 200/43.04 |
| 3,748,881 | A | 7/1973 | Erickson | |
| 3,793,497 | A * | 2/1974 | Di Gaetano | 200/43.08 |
| 3,806,675 | A * | 4/1974 | Krom et al. | 200/43.07 |
| 3,826,116 | A * | 7/1974 | Messera et al. | 70/388 |
| 3,870,842 | A * | 3/1975 | Bergsman | 200/43.08 |
| 3,962,695 | A * | 6/1976 | Peters | 340/542 |
| 3,971,242 | A * | 7/1976 | Mikos | 70/388 |
| 4,029,919 | A * | 6/1977 | Lumme | 200/52 R |
| 4,689,456 | A * | 8/1987 | Martin | 200/43.08 |
| 4,891,477 | A * | 1/1990 | Matsuzawa | 200/61.64 |
| 5,177,466 | A * | 1/1993 | Lai | 340/542 |
| 5,208,579 | A * | 5/1993 | Tseng | 340/542 |
| 5,266,923 | A * | 11/1993 | Tseng | 340/542 |
| 6,133,648 | A * | 10/2000 | Titus et al. | 307/10.2 |

FOREIGN PATENT DOCUMENTS

| | | |
|---|---|---|
| GB | 2261695 | * 5/1993 |
| JP | 602399984 | * 11/1985 |

* cited by examiner

*Primary Examiner*—Michael Friedhofer
*Assistant Examiner*—Lisa Klaus
(74) *Attorney, Agent, or Firm*—Quarles & Brady LLP; Alexander M. Gerasimow

(57) ABSTRACT

An electrical key switch provides a sensing of inserted keys and an ejector mechanism preventing parking of the key in a partially inserted position within the key switch.

17 Claims, 3 Drawing Sheets

ELECTRIC KEY SWITCH WITH KEY SENSING AND EJECTION

BACKGROUND OF THE INVENTION

The present invention relates to electrical switches and in particular to an electrical switch having a key lock and suitable for certain override applications.

In certain applications, for example, those which provide manual override of machine guard features, it is desirable to have an override switch that may be locked against use by all but a single individual using a key or the like.

With any key switch, there is a risk that the key will be left in the lock eliminating its security.

BRIEF SUMMARY OF THE INVENTION

The present invention provides an electrical key switch that may sense the presence of a key within the switch. A key ejector, incorporated into the switch, prevents defeating of the key sensor; that is, "parking" the key or partially inserting the key into the key slot enough to hold the key in place but not to activate the sensing switch is avoided.

Specifically, in one embodiment, the invention provides an electrical key switch having a housing attachable to a support, and a key mechanism receiving a key within a key slot to allow rotation of the key mechanism with respect to the housing. At least one electrical switch element communicates with the key mechanism to switch state with rotation with the key mechanism and an ejector ejects the key from the key slot absent a countervailing pressure on the key holding the key within the key slot.

Thus it is one object of at least one embodiment of the invention to provide an electrical switch which reduces the possibility of the key being forgotten or "parked" in the lock.

The electrical key switch may provide a second electrical switch element communicating with the key mechanism to change state when a key is inserted in the key slot.

It is thus another object of at least one embodiment of the invention to provide a method of electrically sensing the key in the key slot so as to respond appropriately when the key is left in the key slot for too great a length of time.

The ejector may be a shaft passing along the key slot to be displaced by a key inserted into the key slot to activate the second electrical element.

It is thus another object of at least one embodiment of the invention to provide a simple mechanism that serves both as a sensor and ejector of the key.

The shaft may be hardened steel.

It is thus another object of at least one embodiment of the invention to use a simple shape that may be easily fabricated out of hardened steel or other similar material providing stiffness and strength.

The shaft may be positioned along an axis of rotation of a key mechanism to maintain constant axial alignment with respect to the housing during rotation of the key mechanism.

It is thus another object of at least one embodiment of the invention to provide an ejector that may remain substantially aligned with a non-rotating electrical switch element to activate the electrical switch element at a variety of different rotary positions.

The shaft may extend rearwardly from the key slot with respect to an opening of the key slot through which the key is inserted to activate the electrical switch element.

It is thus another object of at least one embodiment of the invention to provide a mechanism in which the key-sensing switch element may be aligned with the key slot to provide a narrow profile switch element fitting in a standard panel area.

The second electrical switch element may be a set of contacts with a travel less than a length of the key slot and further include a spacer block spacing the contacts away from the key slot by an amount at least equal to a difference of the length of the key slot and the travel of the contacts.

Thus it is another object of at least one embodiment of the invention to provide a simple mechanical interface between the ejector shaft which must travel the full length of the key slot to fully eject the key, and the switch which may have a relatively short operator throw.

The housing may include releasable fittings allowing assembly of different combinations of modular contact blocks to the key mechanism including at least one contact block aligned with an axis of rotation of the key mechanism and the spacer may be received by the releasable fitting.

Thus it is one object of at least one embodiment of the invention to provide a mechanism that may be easily integrated with standard multi-application key switches that are assembled out of standard modular blocks.

The ejector shaft may have a coaxial helical extension spring biasing the shaft into the key slot.

It is thus another object of at least one embodiment of the invention to provide an extremely compact mechanism for ejecting the key.

The ejector may provide an average ejecting force on a key inserted into the key of a key slot of at least one half pound.

Thus it is another object of at least one embodiment of the invention to provide a large ejection force to reduce the chance of a key remaining inadvertently in the key slot.

The key mechanism may include a blocking structure allowing insertion of the key into or removal of the key from the slot only when the key mechanism is in a first rotative position and the key mechanism may rotate to a second position when the key is in the key slot.

Thus it is an object of at least one embodiment of the invention to provide an option for the key to be retained in the key slot when in use to prevent the user from having to hold the key when the switch is being activated.

The key mechanism may be spring biased to return to the first rotative position. Alternatively, the key mechanism may not be spring biased so that it remains stably in either the first or second rotative position.

Thus it is another object of at least one embodiment of the invention to provide a variety of different modes of operation of the key switch.

The key mechanism may be a pin tumbler/cylinder lock.

Thus it is another object of at least one embodiment of the invention to provide a simple mechanism that works with standard and readily available lock assemblies.

These particular objects and advantages may apply to only some embodiments falling within the claims and thus do not define the scope of the invention.

DETAILED DESCRIPTION OF THE PREFERRED EMBODIMENT

Figure 1:
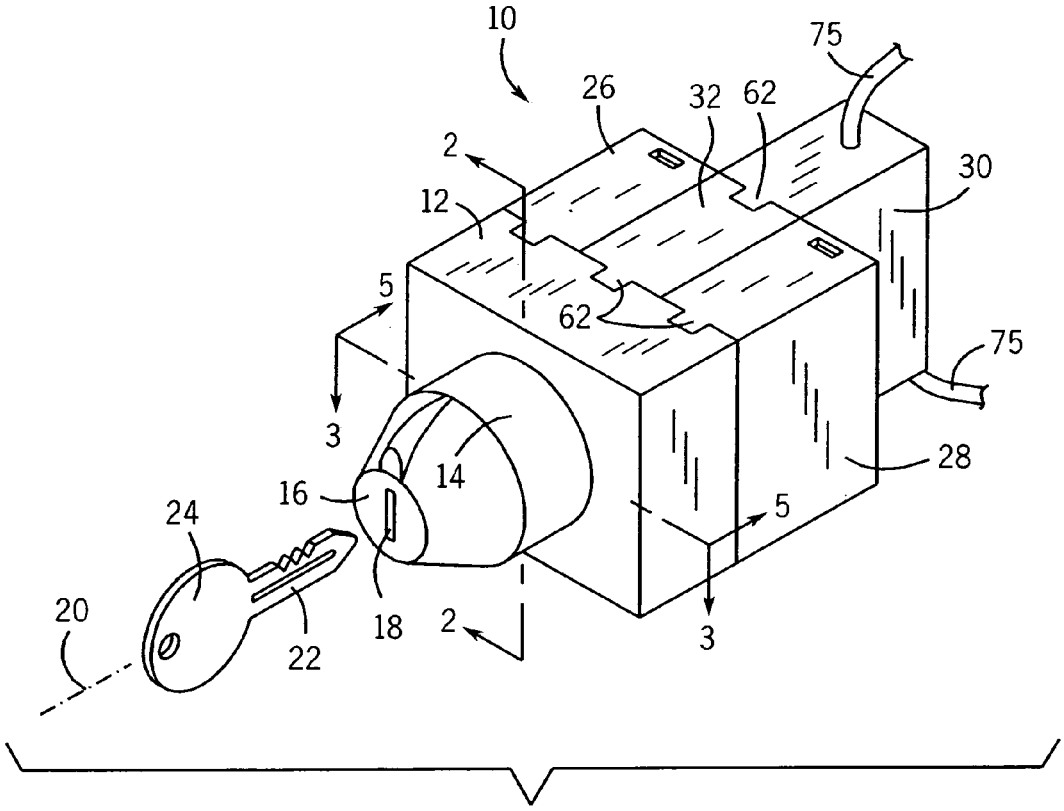
FIG. 1 is a perspective view of a modular electric key switch providing one embodiment of the present invention showing the rotative positions of the cylinder and rear-attached modular contact assemblies.

Referring now to FIG. 1, an electrical key switch 10 of the present invention provides a front housing 12 having an escutcheon 14 surrounding a lock cylinder 16 extending along a cylinder axis 20 from a front face of the front housing 12. The front housing 12 may be attached to a panel or the like (not shown), for example, captured between a front face of the housing 12 and the escutcheon 14 as is generally understood in the art.

The lock cylinder 16 includes a key slot 18 extending along the cylinder axis 20. A blade 22 of a key 24 may be inserted into the key slot 18 when the cylinder 16 is in an insertion orientation as shown in FIG. 1. Once the key 24 is inserted, the key 24 may be rotated to the right or to the left about the cylinder axis 20 to activation positions. As will be described further below, turning the key 24 in the key slot 18 activates contact blocks 26 and 28 positioned at left and right edges of a rear face of the housing 12. The contact blocks 26 and 28 contain contacts (not shown in FIG. 1) which change state (i.e., open or close) depending on the rotative position on the key 24.

A spacer block 32 positioned between the contact blocks 26 and 28, centered on rear face of the housing 12, supports a third contact block 30.

Figure 2:
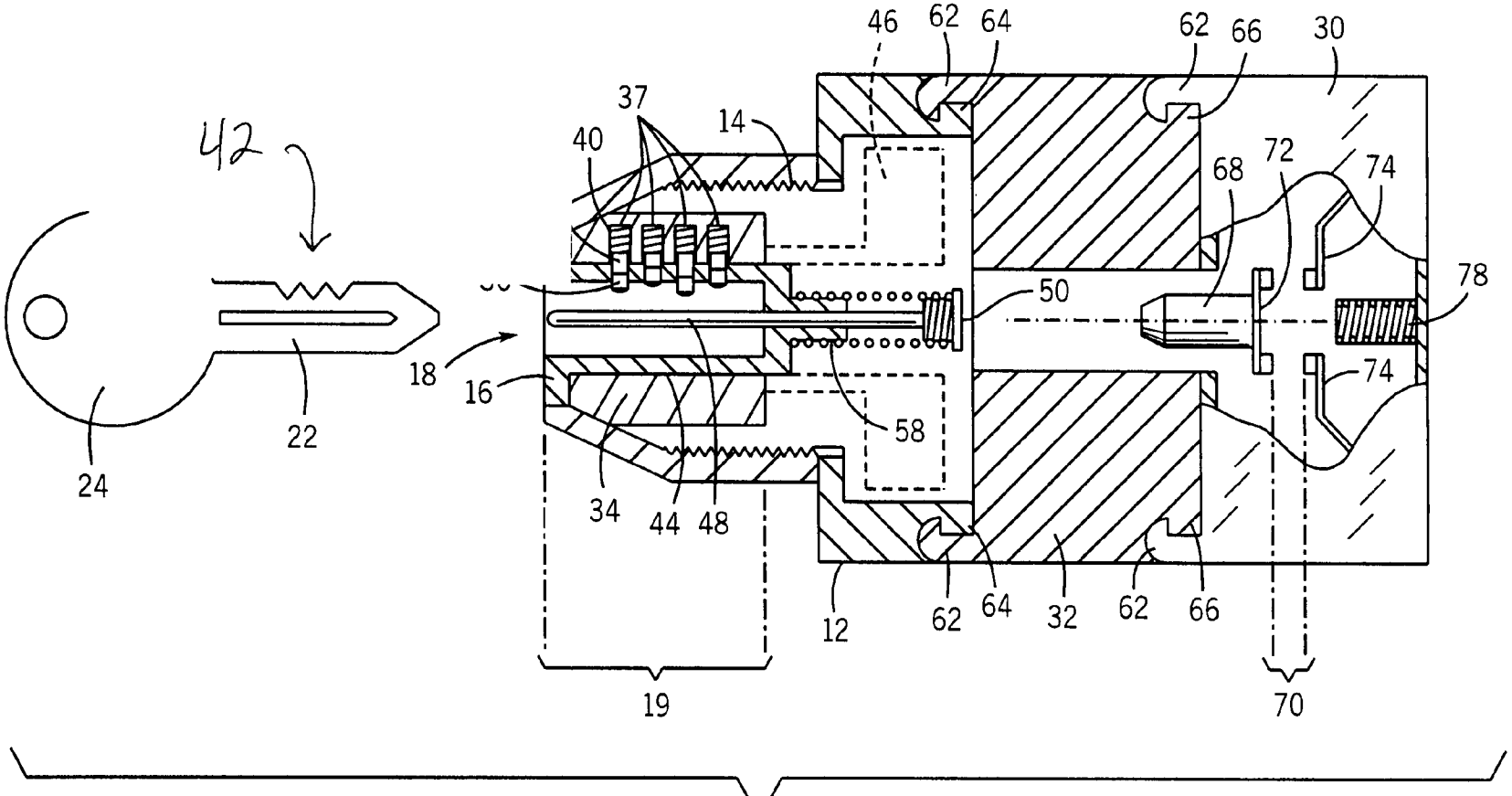
FIG. 2 is a cross-sectional view along 2—2 of FIG. 1 showing an internal ejector shaft within the cylinder of the key switch as may move rearward to close contacts indicating a key has been inserted in the key switch.

Referring also now to FIG. 2, the lock cylinder 16 may rotate within a hull 34 about the cylinder axis 20. A series of radial bores 37 pass through the cylinder 16 and hull 34 to align when the cylinder 16 is in the insertion position allowing movement within the bores 37 of lower key pins 36 and upper drive pins 38 under the influence of compression springs 40 held in the hull 34. The structure is that of a standard pin-tumbler cylinder lock well known in the art.

As will be understood to one of ordinary skill in the art when a blade 22 of the key 24 is inserted in the key slot 18, notches 42 in the upper edge of the blade 22 cause the lower key pins 36 and upper drive pins 38 to move up and down so as to align their interfaces along a shear surface 44 between the cylinder 16 and the hull 34. This alignment allows the cylinder 16 to rotate under the influence of the key 24 with respect to the hull 34 to the activation positions.

In the present invention, the key slot 18 receives an ejector shaft 48 extending along axis 20 through a rear of the cylinder 16 opposite the front of the cylinder 16 through which the blade 22 is inserted in the key slot 18. The shaft 48 is preferably hardened steel to ensure that the shaft 48 will resist deformation by the softer brass blade 22 of the key 24. By using a simple cylindrical shaft 48, complex machining operations on hardened steel are not required.

The shaft 48, prior to insertion of the blade 22 of the key 24 occupies the full length of the key slot 18 along axis 20. In this state, the shaft 48 continues through the rear of the cylinder 16 into the housing 12 terminating at a rear button 50 approximately even with the rear surface of the housing 12.

Figure 4:
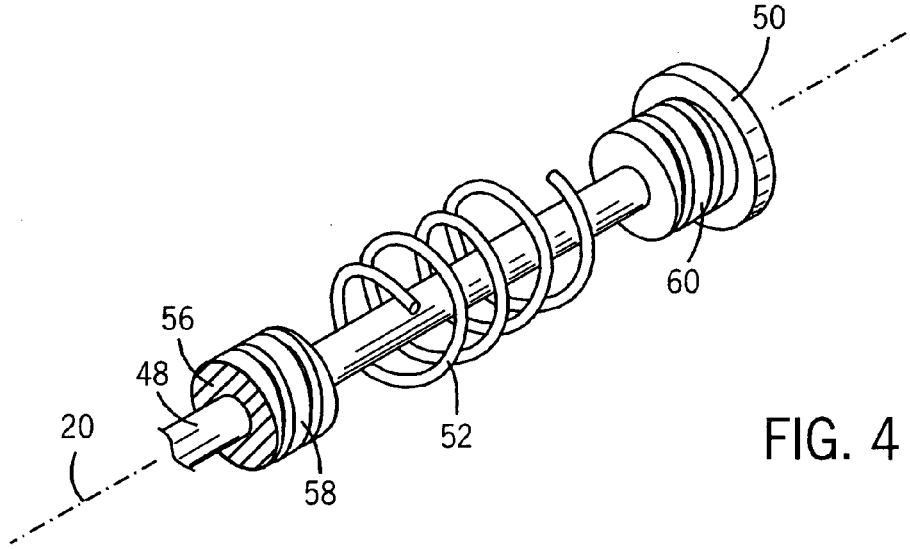
FIG. 4 is a partial, fragmentary perspective view of a rearward portion of the lock cylinder showing its engagement with a helical extension spring used with the ejector shaft.

Referring now to FIGS. 2 and 4, the shaft 48 is free to move along axis 20 through a journal 56 formed by the rear face of the cylinder 16, but is biased into the key slot 18 by a helical extension spring 52. The cylinder 16 and journal 56 may be of brass or other easily machinable material that provides for a natural bearing surface for the hardened and polished steel shaft 48. The outer circumference of the journal 56 has threads 58 of a pitch and diameter suitable to receive the wire end of the helical extension spring 52 threaded thereon. Likewise the rear button 50 of the shaft 48 has threads 60 similarly receiving the opposite end of the helical extension spring 52. In this manner, the helical extension spring 52 is retained coaxially about the shaft 48 to occupy very little additional space. It will be recognized, however, that other methods of biasing the shaft 48, including leaf springs and or the springs associated with electrical contacts of the third contact block 30, described below, may also be used.

Referring again to FIG. 2, each of the contact blocks 26 and 28 and the spacer block 32 have opposed snap hooks 62 extending forward along axis 20 from upper and lower edges of their front faces. These snap hooks 62 may be received by corresponding hook holds 64 formed in the abutting rear face of the housing 12. Thus, contact blocks 26 and 28 may be snapped to the rear face of the front housing 12. Spacer block 32 includes corresponding hook holds 66 in its rear face that may receive the snap hooks 62 of the contact block 30. In this way, contact block 30 may be snapped to spacer block 32 which may be snapped to the rear of housing 12 so that contact block 30 is spaced away from the housing 12 by the width of the spacer block 32.

The snap hooks 62 are preferably molded as part of the housing of the contact blocks 26, 28, and 30 and spacer block 32 to flex outward and then to engage the holds 66 to firmly retain the assembled parts together. Modular switches of this design providing contact blocks 26, 28, and 30, but not spacer block 32 are commercially available from the Rockwell Automation Company.

Contact block 30 like contact blocks 26 and 28 includes an axially extending operator 68 activated by pressing of the operator 68 inward along axis 20 by a operator activation distance 70. The operator 68 connects to a movable contact set 72 which, with motion of the operators 68 by activation distance 70, causes the movable contact set 72 to bridge a stationary contact set 74 against the returning bias of compressing spring 78. The stationary contact set 74 may be connected through terminals or the like to external wiring 75 as shown in FIG. 1. As shown, the contact set 72 and contact set 74 are normally open, however, it will be understood to those of ordinary skill in the art that normally closed contacts may also be used. In an alternative embodiment, the contact sets 72 and 74 may be replaced with other equivalent switch elements including proximity detectors, Hall effect switches, and the like.

Figure 3:
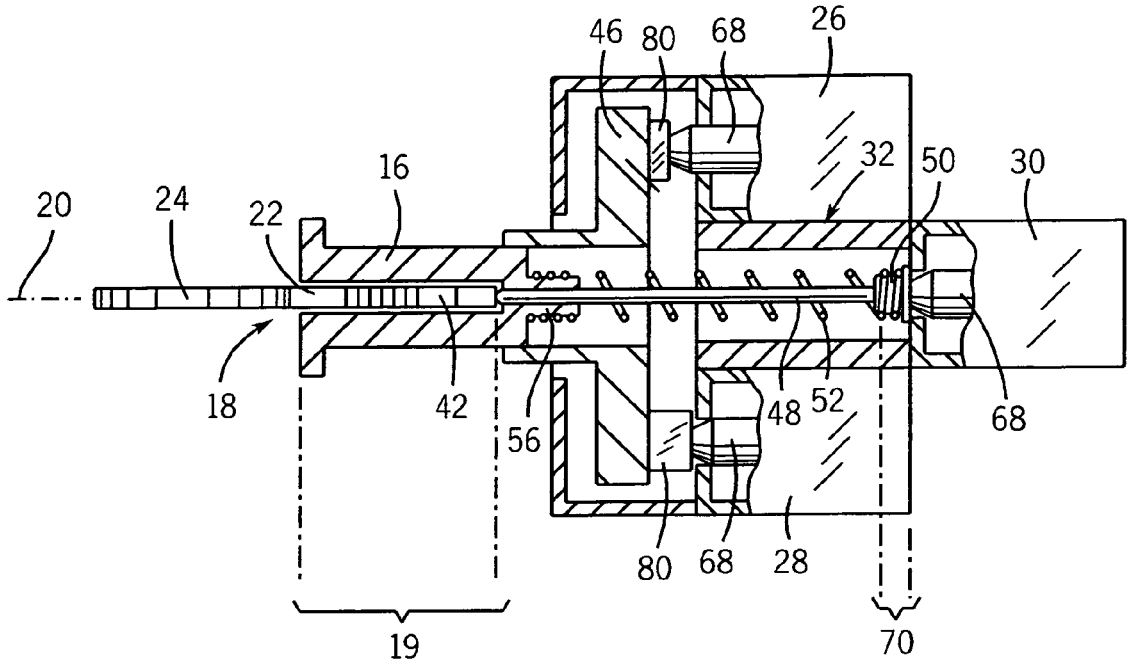
FIG. 3 is cross-sectional view along lines 3—3 of FIG. 1 showing an internal cam mechanism for activating modular contact assemblies with rotation of the key.

Referring to FIG. 3, when the key 24 is fully inserted with its blade 22 extending a full length 19 of the key slot 18, the tip of the blade 22 presses the shaft 48 rearward through the journal 56 to pass through a hollow bore within the spacer block 32 so that the rear button 50 of the shaft 48 compresses the operator 68 of the contact block 30 by the activation distance 70. While the full length 19 of the key slot 18 is greater than the activation distance 70, the spacer block 32 absorbs the extra distance of the movement of the shaft 48 providing compatibility between the desires of moving the operator 68 and activation distance 70 without significant over travel and having the key 24 stay in contact with the shaft 48 as it travels the full length 19 of the key slot 18.

The helical extension spring 52 provides, when the shaft 48 is fully rearward in the key slot 18, a spring force of as much as one pound. Thus an average ejection force of about a half-pound is provided to the key 24 as it is inserted This force is sufficient to move the key 24 against the friction of the key slot 18 and the lower key pins 36 and fully eject the key 24 out of the key slot 18 when the key 24 is released.

Referring still to FIG. 3, when the cylinder 16 is rotated to either activation position from the insertion position, the shaft 48, as aligned with axis 20, remains aligned with the operator 68 of the stationary contact block 30.

The rotation of the cylinder 16 from the insertion position to either activation position moves a cam disk 46 and cam surfaces 80 which may selectively compress the operator 68 of contact block 26 or contact block 28 depending on the direction of rotation of the key. Optional follower blocks (not shown) riding on the cam disk 46 may be interposed between the operators 68 and the cam surfaces 80. Switches of this type having cam disks 46 are well known in the art. The contact block 26 or 28 provide signals indicating key rotation, independent from a signal produced by contact blocks 30, the latter which indicates the presence of the key 24 in the electrical key switch 10 regardless of position of the cylinder 16.

Figure 5:
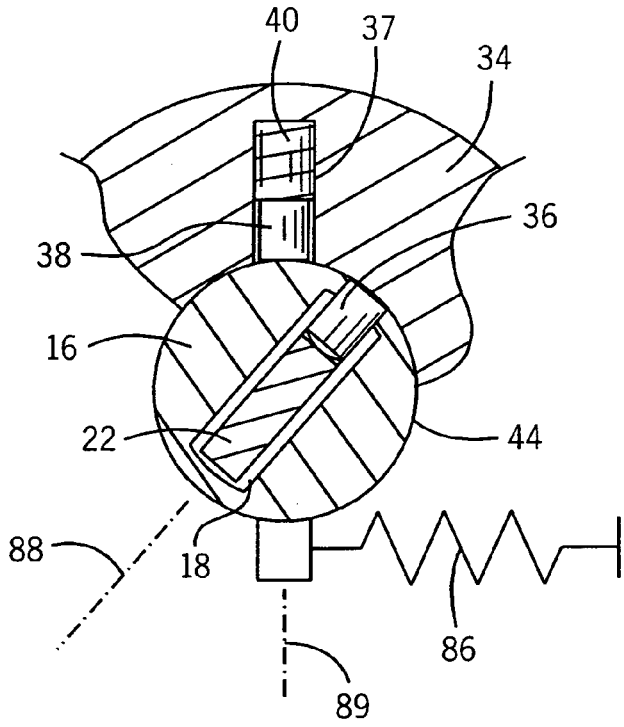
FIG. 5 is a cross sectional view along line 5—5 of FIG. 1 showing the retention of the key by tumblers when the key switch is activated and showing an optional return spring.

Referring now to FIG. 5 when the blade 22 of the key 24 is fully inserted in the key slot 18 of the cylinder 16 and rotated to a first activation position, the lower key pins 36 are trapped beneath the shear surface 44 thus pinning the blade 22 within the key slot 18 preventing its ejection under the influence of the shaft 48. In this manner, after rotation of the cylinder 16, ejection of the key 24 is prevented and activation of the electrical key switch 10 does not require continued holding of the key 24.

Optionally and alternatively, the cylinder 16 may be subject to rotational bias by a spring 86 to cause it to naturally rotate back to the insertion position 89 from one or either activation position 88 in either a counter clockwise or clockwise direction. When such a spring 86 is provided, the operator must retain a grasp on the key 24 or it is ejected as the cylinder 16 returns to the insertion position 89.

It is specifically intended that the present invention not be limited to the embodiments and illustrations contained herein, but include modified forms of those embodiments including portions of the embodiments and combinations of elements of different embodiments as come within the scope of the following claims.

We claim:

1. An electrical key switch comprising:

a housing attachable to a support;

a key mechanism receiving a key within a key slot to allow rotation of the key mechanism with respect to the housing;

a first electrical switch element communicating with the key mechanism to switch state with rotation of the key mechanism;

an ejector ejecting the key from the key slot absent a countervailing pressure on the key holding the key within the key slot;

a second electrical switch element communicating with the key mechanism to change state when a key is inserted into the key slot;

wherein the ejector is a shaft passing along the key slot to be displaced by a key inserted into the key slot to activate the second electrical switch element;

wherein the shaft extends rearwardly from the key slot with respect to an opening of the key slot through which the key is inserted to activate the second electrical switch element;

wherein the second electrical switch element is a set of contacts activating with a travel less than a length of the key slot and further including a spacer block spacing the contacts away from the key slot by an amount at least equal to a difference between the length of the key slot and the travel of the contacts; and wherein the housing includes at least one releasable fitting allowing assembly of different combinations of modular contact blocks to the key mechanism including at least one contact block aligned with an axis of rotation of the key mechanism and wherein the spacer is received by the releasable fitting.

2. The electrical key switch of claim 1 wherein the shaft is hardened steel.

3. The electrical key switch of claim 1 wherein the shaft is positioned along an axis of rotation of the key mechanism to maintain a constant axial alignment with respect to the housing during rotation of the key mechanism.

4. The electrical key switch of claim 1 wherein the ejector provides an average ejecting force on a key inserted into the key slot of at least one half pound.

5. The electrical key switch of claim 1 wherein the key mechanism includes blocking structure allowing insertion of the key into or removal of the key from the key slot only when the key mechanism is in a first rotative position and wherein the key mechanism may rotate to a second position when the key is in the key slot.

6. The electrical key switch of claim 5 wherein the key mechanism is spring biased to return to the first rotative position.

7. The electrical key switch of claim 5 wherein the key mechanism is not spring biased to remain stably in either the first or second rotative position.

8. The electrical key switch of claim 1 wherein the ejector ejects the key from the key slot in a first rotative position of the key mechanism but not in a second rotative position of the key mechanism.

9. The electrical key switch of claim 1 wherein the shaft is biased by a spring to extend into the key slot substantially a length of the key slot whereby the key is fully ejected from the key mechanism by the ejector.

10. The electrical key switch of claim 1 wherein the key mechanism is a pin tumbler/cylinder lock.

11. An electrical key switch comprising:

a housing attachable to a support;

a key mechanism receiving a key within a key slot to allow rotation of the key mechanism with respect to the housing;

at least one electrical switch element communicating with the key mechanism to switch state with rotation of the key mechanism;

an ejector ejecting the key from the key slot absent a countervailing pressure on the key holding the key within the key slot wherein the ejector is a shaft having a coaxial helical extension spring biasing the shaft into the key slot; and wherein the coaxial helical spring is retained at one end by a thread receiving a helical wire end of the helical extension spring.

12. An electrical key switch comprising:

a housing attachable to a support;

a key mechanism receiving a key within a key slot to allow rotation of the key mechanism with respect to the housing;

a first electrical switch element communicating with the key mechanism to switch state with rotation of the key mechanism;

a second electrical switch element;

a shaft passing along the key slot to be displaced by a key inserted into the key slot to activate the second electrical switch element;

wherein the shaft extends rearwardly from the key slot with respect to an opening of the key slot through which the key is inserted to activate the second electrical switch element;

wherein the second electrical switch element is a set of contacts activating with a travel less than a length of the key slot and further including a spacer block spacing the contacts away from the key slot by an amount at least equal to a difference between the length of the key slot and the travel of the contacts; and wherein the housing includes at least one releasable fitting allowing assembly of different combinations of modular contact blocks to the key mechanism including at least one contact block aligned with an axis of rotation of the key mechanism and wherein the spacer is received by the releasable fitting.

13. The electrical key switch of claim 12 wherein the shaft is hardened steel.

14. The electrical key switch of claim 12 wherein the shaft is positioned along an axis of rotation of the key mechanism to maintain a constant axial alignment with respect to the housing during rotation of the key mechanism.

15. The electrical key switch of claim 12 wherein the shaft provides an average ejecting force on a key inserted into the key slot of at least one half pound.

16. An electrical key switch comprising:

a housing attachable to a support;

a key mechanism receiving a key within a key slot to allow rotation of the key mechanism with respect to the housing;

a first electrical switch element communicating with the key mechanism to switch state with rotation of the key mechanism;

a second electrical switch element;

a shaft passing along the key slot to be displaced by a key inserted into the key slot to activate the second electrical switch element wherein the shaft has a coaxial helical extension spring biasing the shaft into the key slot; and wherein the coaxial helical spring is retained at one end by a thread receiving a helical wire end of the helical extension spring.

17. An electrical key switch comprising:

a housing attachable to a support;

a key mechanism receiving a key within a key slot to allow rotation of the key mechanism with respect to the housing;

a first electrical switch element communicating with the key mechanism to switch state with rotation of the key mechanism;

an ejector ejecting the key from the key slot absent a countervailing pressure on the key holding the key within the key slot;

a second electrical switch element communicating with the key mechanism to change state when a key is inserted into the key slot;

wherein the ejector is a shaft passing along the key slot to be displaced by a key inserted into the key slot to activate the second electrical switch element;

wherein the housing includes at least one releasable fitting allowing assembly of different combinations of modular contact blocks to the key mechanism including at least one contact block aligned with an axis of rotation of the key mechanism and wherein the spacer is received by the releasable fitting.

* * * * *

UNITED STATES PATENT AND TRADEMARK OFFICE

CERTIFICATE OF CORRECTION

PATENT NO. : 6,969,810 B1
APPLICATION NO. : 10/853525
DATED : November 29, 2005
INVENTOR(S) : Davidsz It is certified that error appears in the above-identified patent and that said Letters Patent is hereby corrected as shown below:

Title Page,
Item (75) Inventor,

"Mark E. Davidsz, Oak Creek, WI (US)"

should be

--Mark E. Davidsz, Oak Creek, WI (US); Frank J. Graninger, Wind Lake WI (US)--.

Signed and Sealed this

Seventeenth Day of April, 2007

JON W. DUDAS
*Director of the United States Patent and Trademark Office*